US006441292B1

(12) United States Patent
Donnell

(10) Patent No.: US 6,441,292 B1
(45) Date of Patent: Aug. 27, 2002

(54) MULTIPLE GOOSENECK MICROPHONES AND METHODS FOR ATTACHMENT

(76) Inventor: Kenneth D. Donnell, P.O. Box 433, Greenville, CA (US) 95947

( * ) Notice: Subject to any disclaimer, the term of this patent is extended or adjusted under 35 U.S.C. 154(b) by 0 days.

(21) Appl. No.: 09/167,807

(22) Filed: Oct. 7, 1998

(51) Int. Cl.[7] ..... G10H 3/00
(52) U.S. Cl. ..... 84/723; 84/725; 84/743
(58) Field of Search ..... 84/723–728, 730–731, 84/743, DIG. 24

(56) References Cited

U.S. PATENT DOCUMENTS 4,168,647 A * 9/1979 Petillo ..... 84/1.14
4,356,754 A * 11/1982 Fishman ..... 84/1.16
4,404,885 A 9/1983 Salak ..... 84/329
4,495,641 A 1/1985 Vernino ..... 84/1.16
4,748,886 A 6/1988 DeByl ..... 84/1.14
5,010,803 A * 4/1991 Donnell ..... 84/743
5,614,688 A * 3/1997 Donnell ..... 84/743

* cited by examiner

*Primary Examiner*—Marlon T. Fletcher

(57) ABSTRACT

A design for a transducer assembly which embodies two separate microphone elements attached to two separate goosenecks where both microphone/gooseneck assemblies are connected to a single service housing. The goosenecks are constructed in a unique method in order to provide a wide range of mounting positions while simultaneously protecting the microphone elements from distortion due to ambient mechanical energy. The designs include methods for mounting microphones and other transducers onto musical instrument or other fixtures using two part fastening systems, elastic cords, padded hooks, and other devices. An optional microphone cover is described which will serve to reduce or eliminate feedback and other unwanted sounds.

7 Claims, 19 Drawing Sheets

MULTIPLE GOOSENECK MICROPHONES AND METHODS FOR ATTACHMENT

BACKGROUND OF THE INVENTION

Double element microphones (X-Y microphones) have been known in the art for many years. The simultaneous use of two microphone elements often produces superior results to using merely one element. Benefits include reduction of feedback and/or unique sound enhancement by effects such as delay, stereo sourcing, etc.

Prior Art FIG. 1 shows a typical X-Y microphone consisting of an assembly which embodies two individual microphone elements connected to a separate service housing via soft, flexible, output cables. The only function of the soft output cables is to conduct the electronic signals from the microphone element to the service housing. The output cables employ no mechanical function to mount the microphone elements. The microphone elements can be mounted by only attachment to separate fixtures which are not a part of the microphone assembly. In particular, there is no prior art depicting methods for mounting X-Y microphones directly on to musical instruments.

Foam enclosures have often been used in the form of "windscreens" or "windsocks" to enhance the performance of microphones. Prior Art FIG. 2 shows a typical windscreen. Other foam enclosures have also been shown in prior art for the purpose of preventing feedback, shock mounting the microphone to prevent distortion, and otherwise enhancing tonal reproduction from microphones. Prior Art FIG. 3 shows a foam enclosure by Debyl in U.S. Pat. No. 4,748,886. Prior Art FIG. 4 shows a foam enclosure for a microphone designed by the author of this patent application in U.S. Pat. No. 5,614,688.

Such devices shown in prior art have reduced distortion from wind and helped to reduce feedback, but neither of these problems have been completely resolved. Debyl's designs also have the disadvantage of dampening the natural acoustic sound of a guitar where such a foam enclosure is inserted.

Feedback is created when air vibrations originating from electronic speakers re-enter the original source microphone a fraction of a second after the original acoustic signal was recorded. This sequence of events creates a self generating electronic loop which the amplification system cannot manage, and the result is the annoying scream of feedback. If the air vibrations from the speakers can be blocked or delayed from re-entering the source microphone, feedback can be reduced or eliminated.

Flexible shafts in the form of goosenecks are well known in the art of mounting microphones. Prior Art FIG. 5 shows a gooseneck for mounting a microphone on to a musical instrument designed by the author of this patent application in U.S. Pat. No. 5,010,803. However, this design and other prior goosenecks do not provide sufficient "shock mounting" to isolate and protect the microphone element from distortion due to ambient mechanical vibrations originating from the musical instrument and transferred to the rigid materials of the gooseneck.

There are existing designs in prior art which do provide excellent shock mounting via a matrix of cables which suspend the microphone element so that there is no mechanical connection to the supporting fixture. But, such matrix mechanisms cannot be effectively mounted directly onto musical instruments due to excessive size, weight, or poor adjustability. A typical matrix mounting mechanism is shown in Prior Art FIG. 6.

Prior art shows many devices for attaching microphones and other transducers to musical instruments. Prior Art FIGS. 7 & 8 show a design from U.S. Pat. No. 4,495,641 by Vernino using suction cups to attach a microphone to a guitar.

Prior Art FIG. 9 shows a design by Petillo in U.S. Pat. No. 4,168,647 to employ a telescoping arm to mount a transducer on a guitar. Prior Art FIG. 10 shows a design by Salak in U.S. Pat. No. 4,404,885 using a clamping device to mount a microphone on a cello or stringed bass.

The above mounting devices are functional, but have limitations regarding:

- how inconspicuous the transducer can be placed on the instrument,
- the degree of flexibility which the musician will have in locating the transducer on the instrument,
- and/or the degree to which components of the transducer or its mounting mechanisms will interfere with the musicians' ability to play the musical instrument.

SUMMARY OF THE INVENTION

The present invention is a unique microphone assembly having multiple microphone elements attached to individual flexible mounting arms, or goosenecks. The goosenecks are physically and electronically connected to a single housing which encloses electronics and other components required to service and operate the microphones. The goosenecks may be maneuvered independently to provide optimum recording of acoustical energy from a musical source.

Much of the description of this invention mentions the use of only two goosenecks. But, it is possible to employ three or more goosenecks having attached microphone elements with any of the devices described herein.

An optional design for a microphone assembly is shown where the goosenecks and service housing are embodied in two separate sub-assemblies which are joined by both a soft flexible output cable, and an elastic cord.

The invention includes designs for an optional foam cover to enclose a microphone element. Porous and non porous materials are embedded within the foam cover which will filter, delay, and/or block access of specific acoustical energy to the microphone element. This will reduce or eliminate feedback and other unwanted sounds from being recorded by the microphone element.

The invention also includes unique methods for constructing a gooseneck assembly to support and position a microphone. The gooseneck design will simultaneously provide excellent isolation, or shock absorption to the microphone element. This shock absorption will prevent distortion of the microphone element caused by ambient mechanical energy travelling along the rigid materials of the gooseneck.

Finally the invention includes unique methods for attaching microphones and other transducers to musical instruments or other fixtures using elastic cords, hooks, clips, and/or two part fastener systems. These mounting methods will position the transducer on the musical instrument in the location for optimum performance, but not so as to interfere with the musician playing the instrument. Many of these mounting methods will require no permanent modification to the musical instrument.

BRIEF DESCRIPTION OF THE DRAWINGS

A microphone assembly with three goosenecks and attached microphone elements is shown

Preferred Embodiment of the Invention

Figure 1:
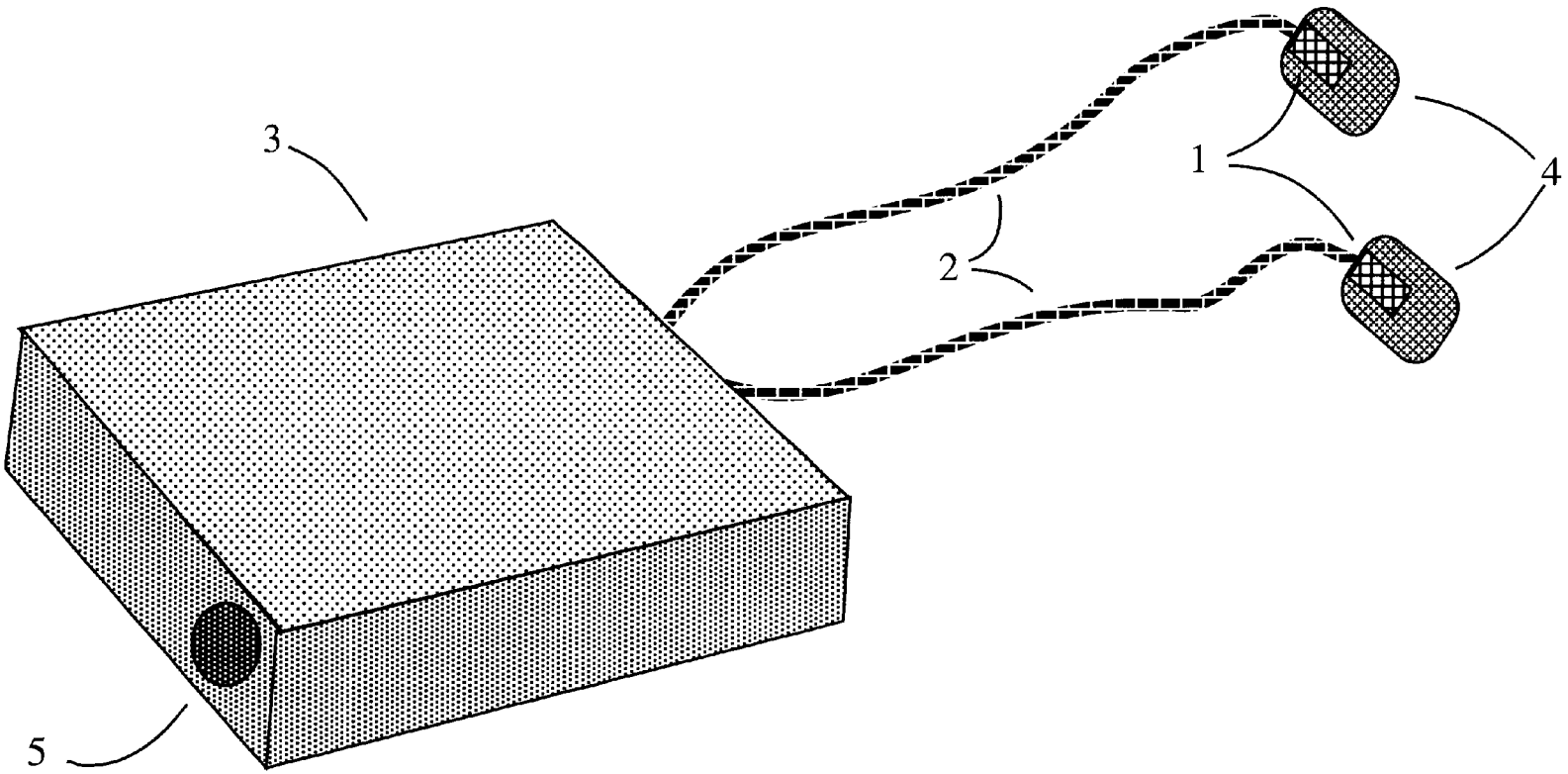
FIG. 1 shows a microphone assembly having two separate microphone elements attached to separate flexible mounting arms, or goosenecks. The goosenecks are mechanically and electronically attached to a service housing which encloses electronic components.

FIG. 1 shows a microphone assembly consisting of two separate microphone elements 1 attached to separate flexible mounting arms, or goosenecks 2. Both goosenecks 2 emerge in a parallel direction from a service housing 3 that encloses an output connector 5 and other electronic components required to service both microphone elements 1.

Figure 2:
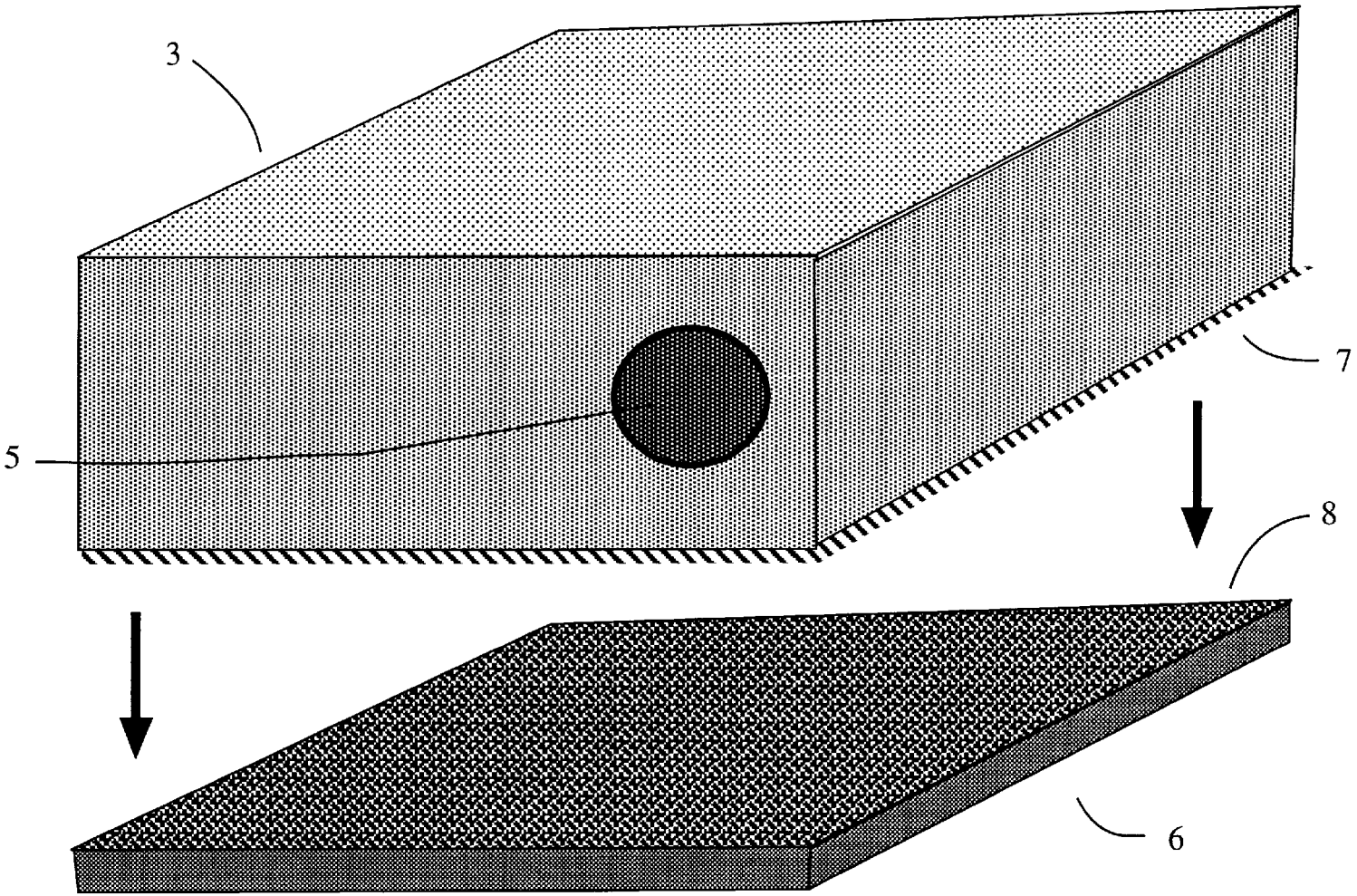
FIG. 2 shows an end view of the service housing from FIG. 1 as it will be attached to a mounting pad using hook and loop materials, or a similar two part fastening system.

FIG. 2 shows the application of a reusable two part fastener system (commonly known as Hook and Loop Fasteners) to mount the service housing 3 to a separate self adhesive mounting pad 6. The bottom of the service housing 3 is covered by the hook material 7. The mating loop material 8, is attached to the mounting pad 6. The mounting pad 6 shown in FIG. 2 is a thin, flat, self adhesive membrane capable of attachment to a musical instrument or other mechanism which is not a part of the invention of this patent application. The mounting pad 6 can also be composed of suction cups, magnetized materials, adhesive tape or film, materials capable of being stabilized by static friction, and/or similar mechanical devices. When the mounting pad 6 is attached to a musical instrument or other fixture (not shown in this figure), the service housing 3 can be attached to the mounting pad 6, thereby mounting the microphone assembly on to the musical instrument or fixture.

Figure 3:
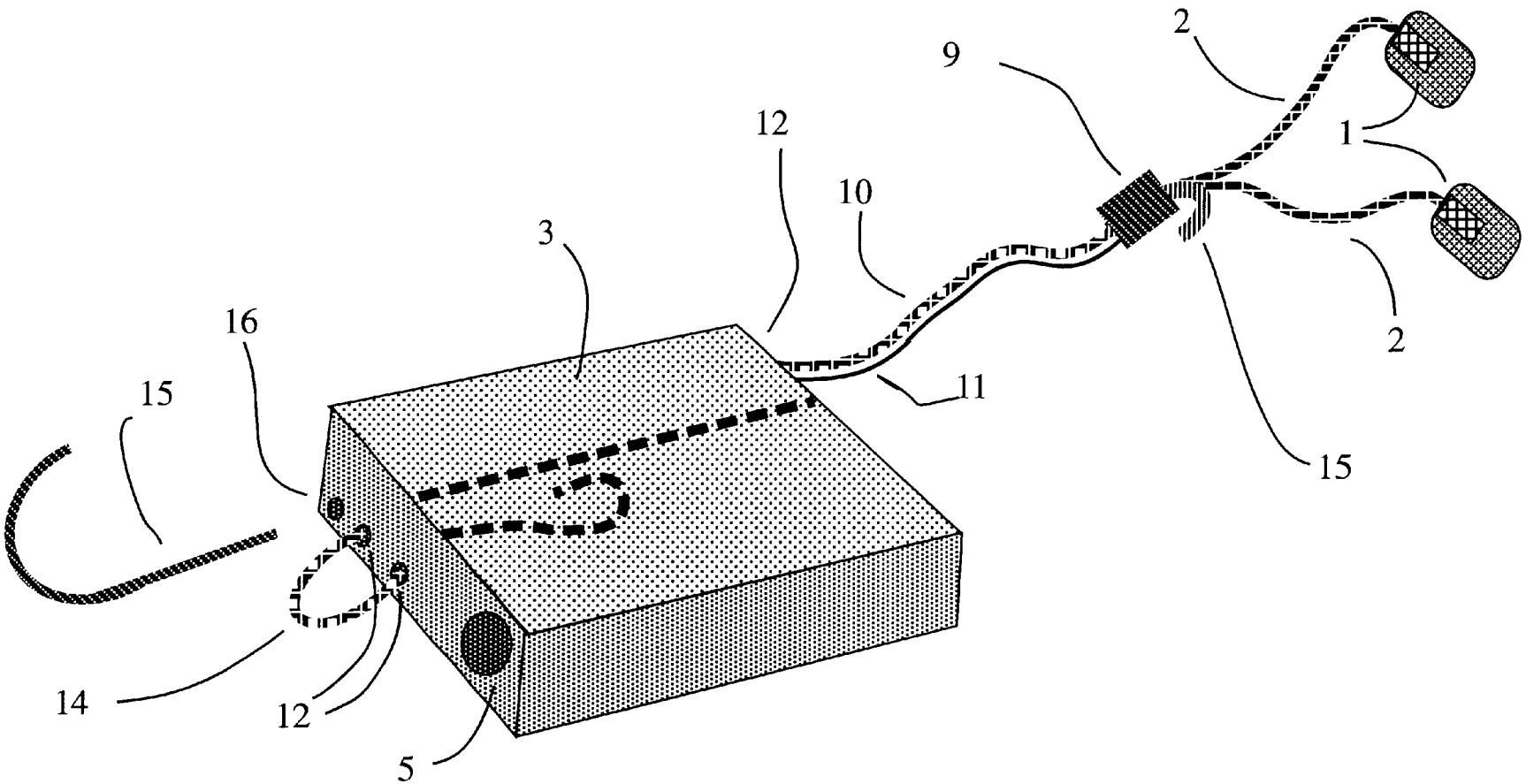
FIG. 3 shows the microphone assembly arranged into two separate sub-assemblies which are connected by a soft, flexible output cable, and an elastic cord. An optional mounting appendage is shown having been received by the service housing.

FIG. 3 shows a microphone assembly arranged into two separate sub-assemblies which are connected by an elastic cord 10 and soft, flexible output cable 11. For one sub-assembly, the goosenecks 2 which embody the microphone elements 1 are attached to a mounting apparatus 9. The mounting apparatus 9 may employ components a variety of fixed or adjustable mounting appendages 15. The second sub-assembly consists of the service module 3 which is mechanically connected to the mounting apparatus 9 by an elastic cord 10. The output cable 11 electronically connects the microphone elements 1 to any electronic components enclosed within service housing 3, such as an output connector 5. The elastic cord 10 enters, exits and re-enters the service module 3 through openings 12. When tension is applied to the elastic cord 10 by the mounting apparatus 9, the adjustment loop 14 will "lock" against the openings 12 in the service module 3 and permit adjustment of the elastic cord 10 to a variety of lengths as required by specific applications. FIG. 3 also shows an optional method for mounting the service module 3 by use of a mounting appendage 15 which can be received into an opening 16 in the service module 3. Both of the mounting appendages 15 received by the service module 3 and mounting apparatus 9 may secured by mating threads, friction, spring loaded connectors, and/or similar mechanical devices. The mounting appendages 15 shown in FIG. 3 are in the shape of a hook, but may be of any fixed shape using materials such as plastic, wood, or hardened metals.

Figure 4:
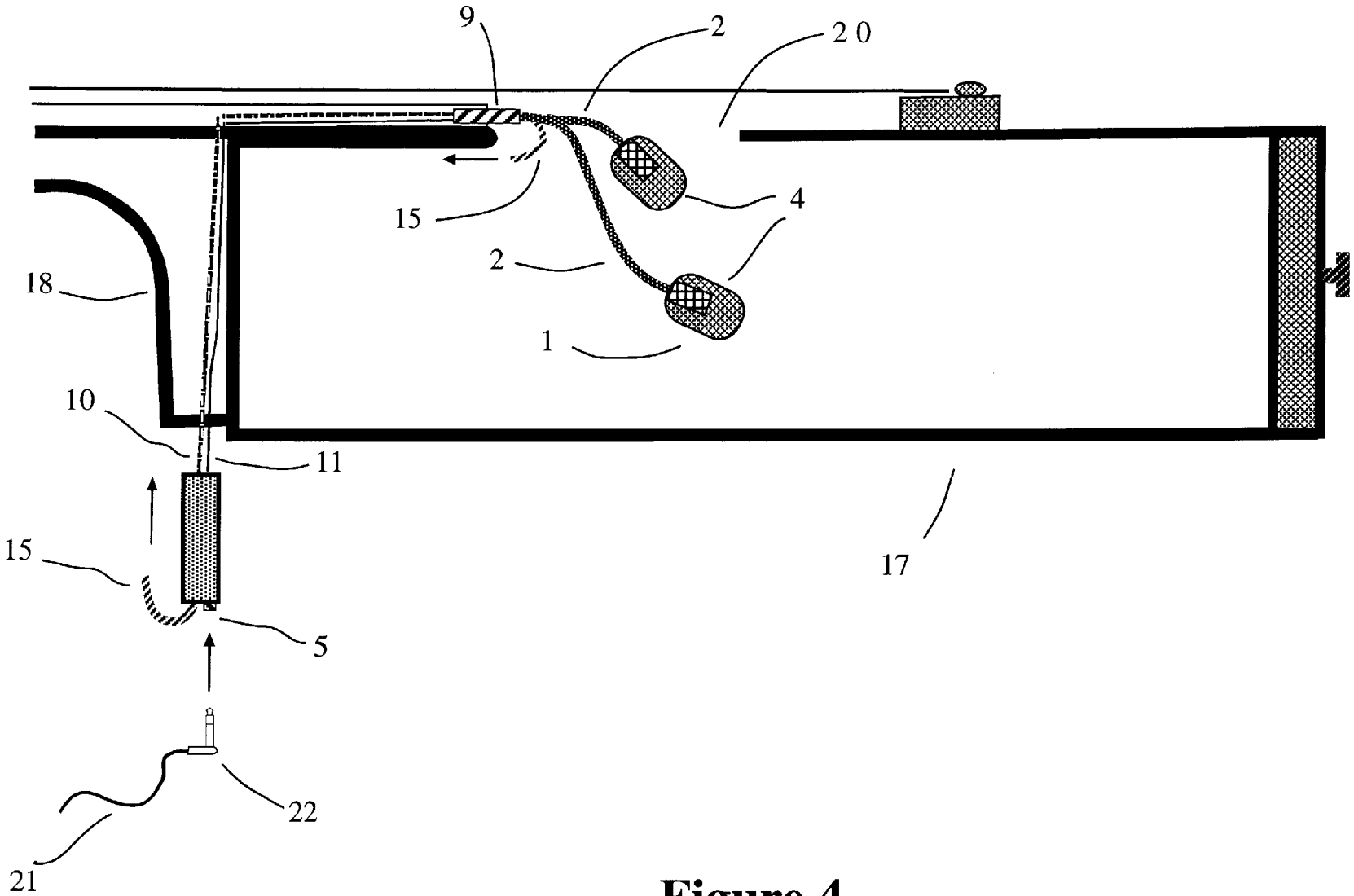
FIG. 4 shows a cut-away side view of the microphone assembly in FIG. 3 being installed into a guitar using the mounting appendage.

FIG. 4 shows a cut-away side view of the microphone assembly in FIG. 3 being installed into a guitar 17 or similar musical device having a soundhole or sound portal. The goosenecks 2 which embody the microphone elements 1 are inserted into the soundhole 20 while the gooseneck mounting apparatus 9 attaches to the edge of the soundhole 20 using an attached mounting appendage 15. The service housing 3 has also received a mounting appendage 15 and may be attached to the heel 18 of the guitar 17. The elastic cord 10 connecting the mounting apparatus 9 to the service housing 3 provides sufficient tension to secure the goosenecks 2 inside the soundhole 20, and simultaneously stabilize the service housing 3 to the heel 18 of the guitar 17. Both of the mounting appendages 15 and any other components of the transducer assembly may coated to protect the surface of the guitar 17 from damage through physical contact. An audio connector 22 is shown attached to a cable 21 which can communicate with other electronic devices. The audio connector 22 can be received by the output connector 5 enclosed within the service housing 3

Figure 5:
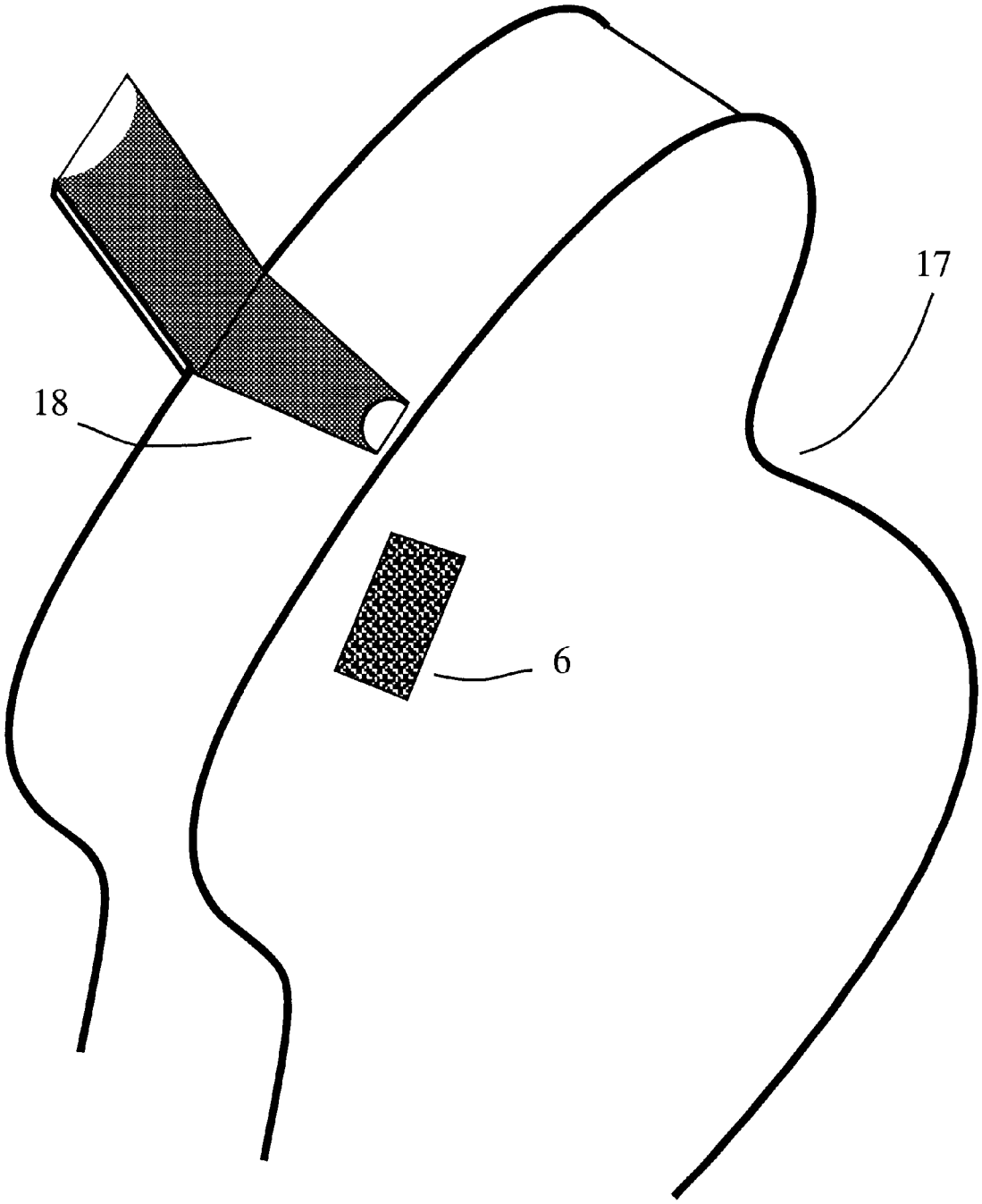
FIG. 5 shows the self adhesive mounting pad of FIG. 2 attached to the rear of an acoustical guitar.
Figure 6:
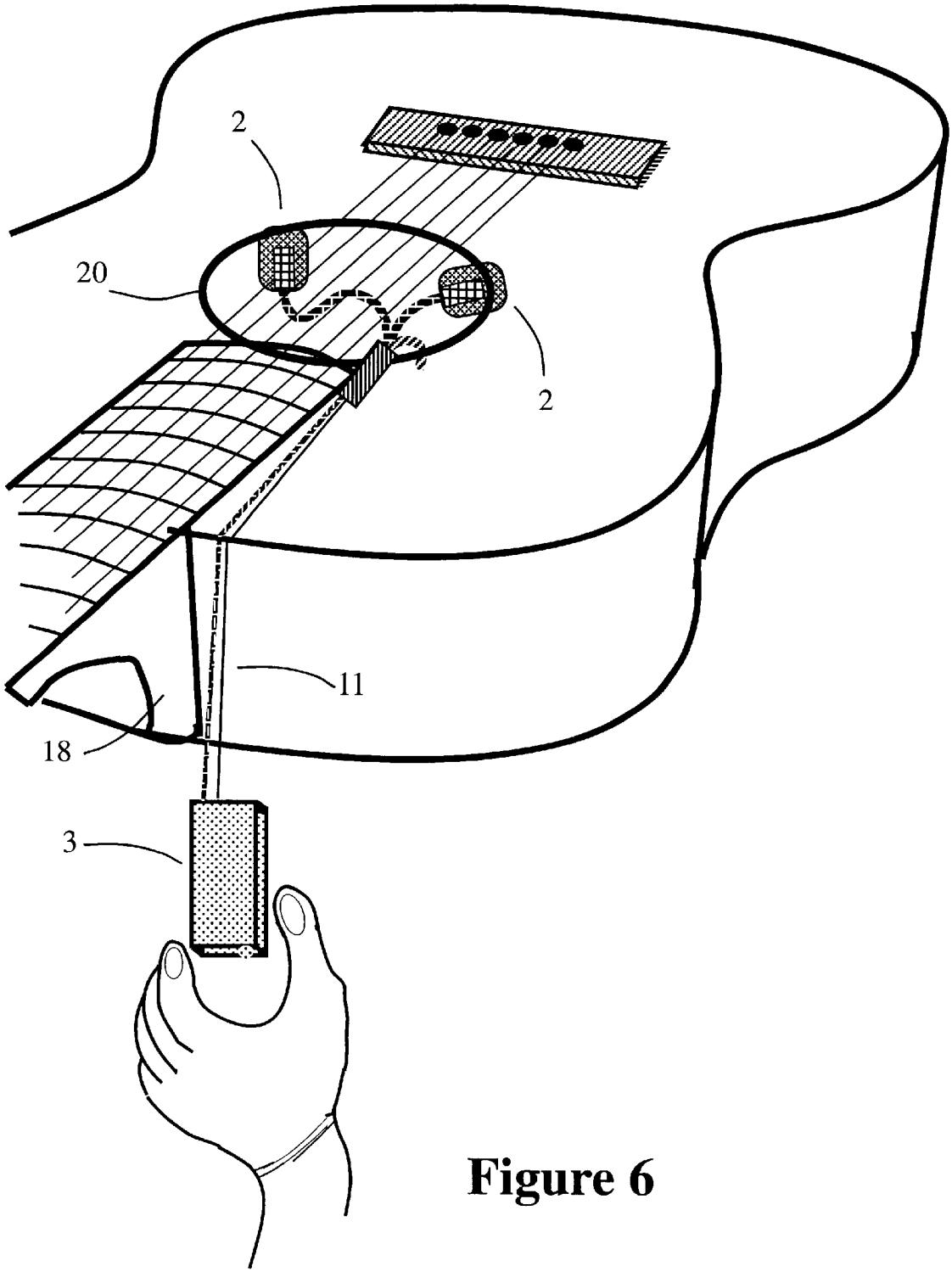
FIG. 6 shows the gooseneck mounting apparatus which embodies the microphone elements and goosenecks being attached to the soundhole of an acoustic guitar.
Figure 7:
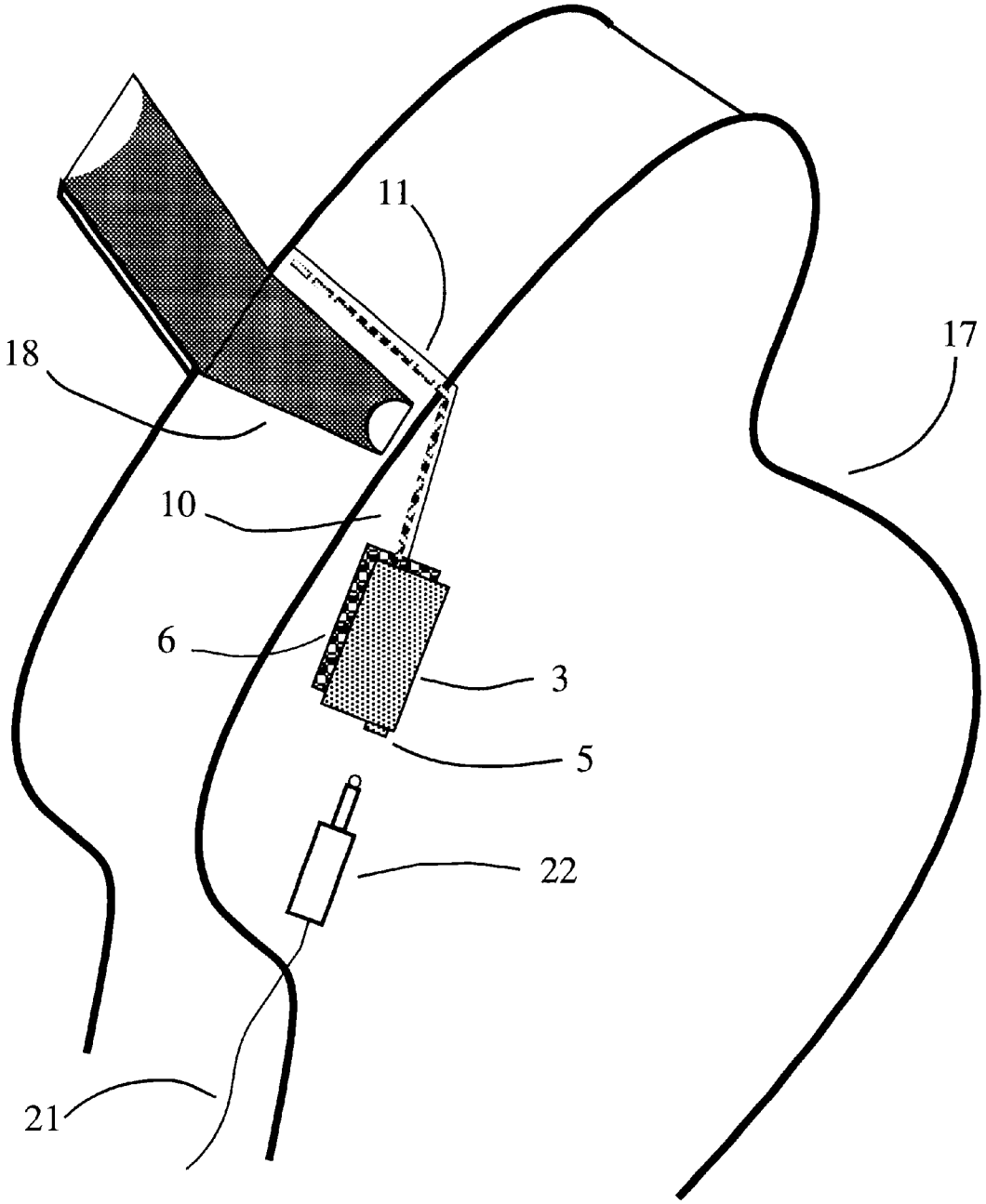
FIG. 7 shows the service housing attached to the mounting pad on the back side of an acoustic guitar.

FIGS. 5–7 show mounting of the microphone assembly of FIG. 3 on an acoustic guitar using the self adhesive mounting pad of FIG. 2.

FIG. 5 shows the self adhesive mounting pad 6 of FIG. 2 attached to the rear of an acoustical guitar 17. The outside face of the mounting pad 6 is covered with the loop material 8 of a two part fastening system, FIG. 6 shows the gooseneck mounting apparatus 9 being attached to the soundhole 20 of an acoustic guitar 17. The service housing 3 is attached to the gooseneck mounting apparatus 9 by an elastic cord 10 and a soft flexible output cable 11 as shown in FIG. 4.

FIG. 7 shows the service housing 3 of the microphone assembly in FIGS. 3 & 6 attached to the mounting pad 6 of FIG. 5 using a two part fastener system. The elastic cord 10 and output cable 11 stretch around the heel of the guitar 18 and attach to the service housing 3. An audio connector 22 is shown attached to a cable 21 can be received by the output connector 5 enclosed within the service housing 3 for the purpose of communicating with other electronic devices.

Figure 8:
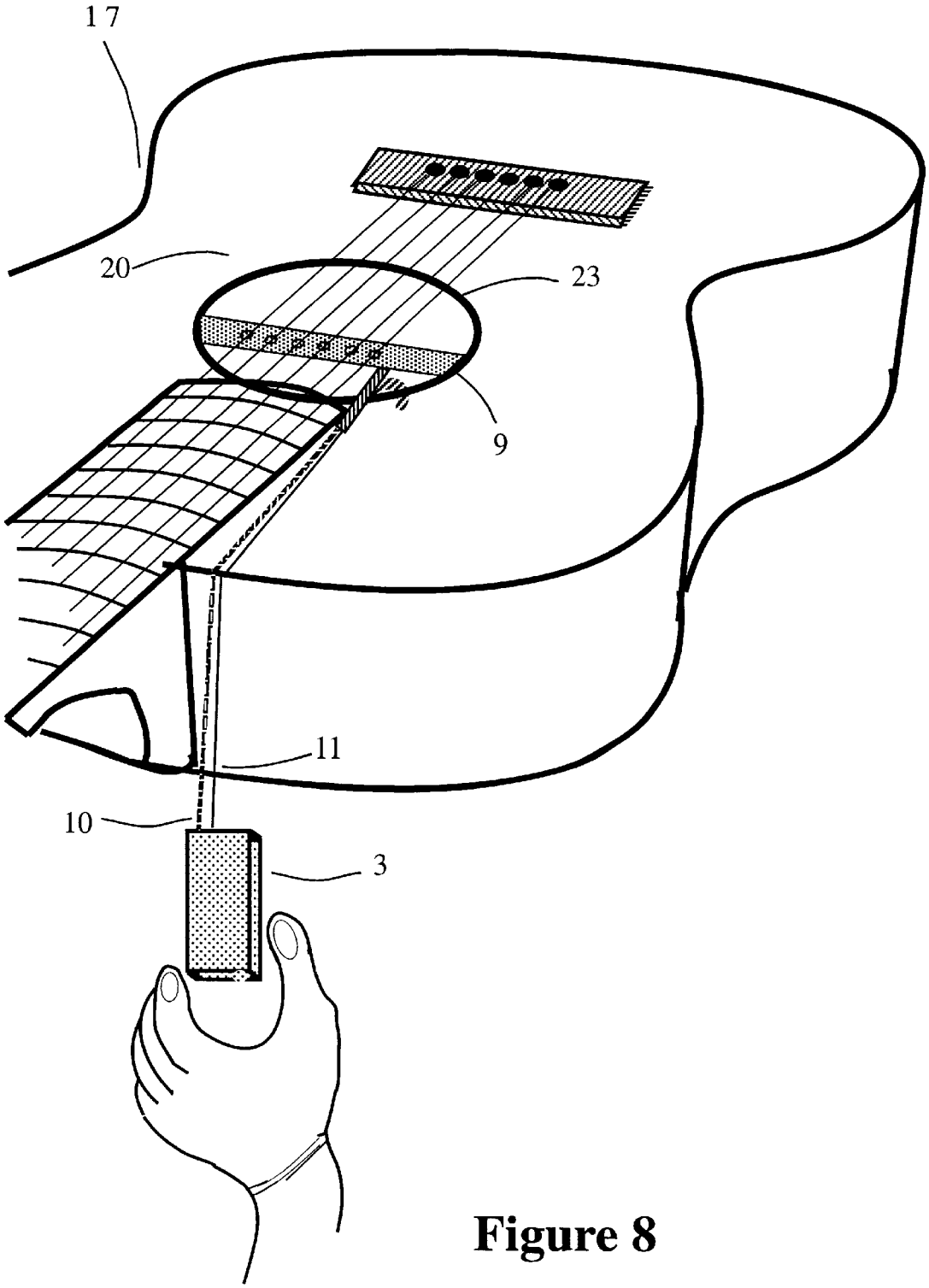
FIG. 8 shows a variation of FIG. 6 where the transducer is an electromagnetic pickup.

FIG. 8 shows a variation of FIG. 6 where the transducer mounted in the soundhole 20 is an electromagnetic pickup 23.

Figure 9:
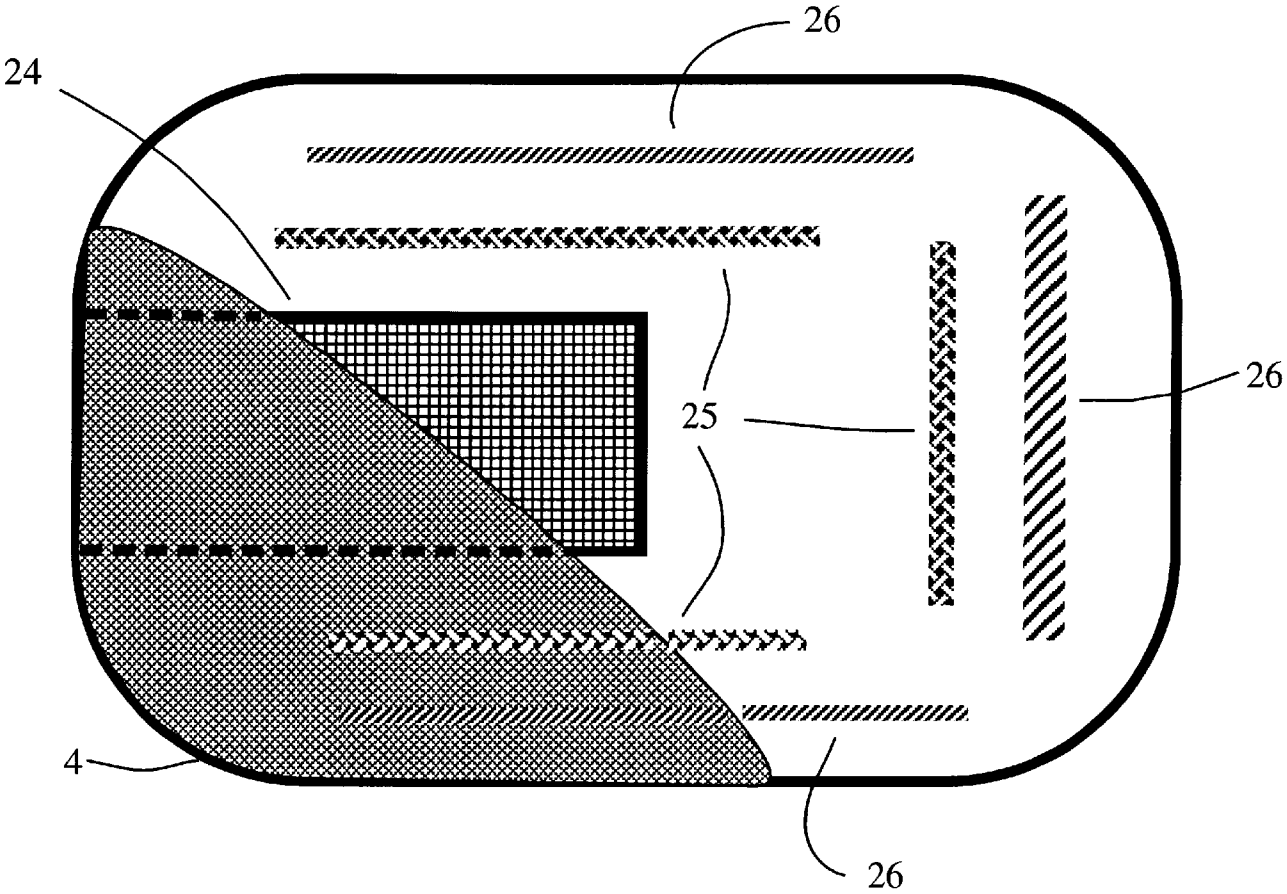
FIG. 9 shows a cross section of a foam microphone element cover which embodies a matrix of porous baffles and non porous baffles embedded within the foam cover. The baffles are arranged in patterns to block, filter, and/or delay access of specific acoustical vibrations to an enclosed microphone element.

FIG. 9 shows a cross section of a foam microphone element cover 4 which has an opening 24 to receive a microphone element (not shown in this figure). A matrix of porous baffles 25 and non porous baffles 26 embedded within the foam cover 24. The porous baffles 25 can be composed of cloth, high density foam, wire mesh, or similar materials. The non-porous baffles 26 can be composed of plastic, metal, wood, or similar materials. The baffles 25 & 26 are to be arranged in a manner so that there is limited access, or no direct access for the acoustical energy to pass from its source to a microphone element enclosed by the cover 4. This limited access will permit the primary acoustical energy from the original musical source to pass undisturbed through the matrix, while the weaker secondary energy of outside speakers will be delayed to reduce or eliminate feedback. The precise arrangement of the porous baffles 25 and/or the non-porous baffles 26 can be altered to meet the needs of specific acoustic applications.

Figure 10:
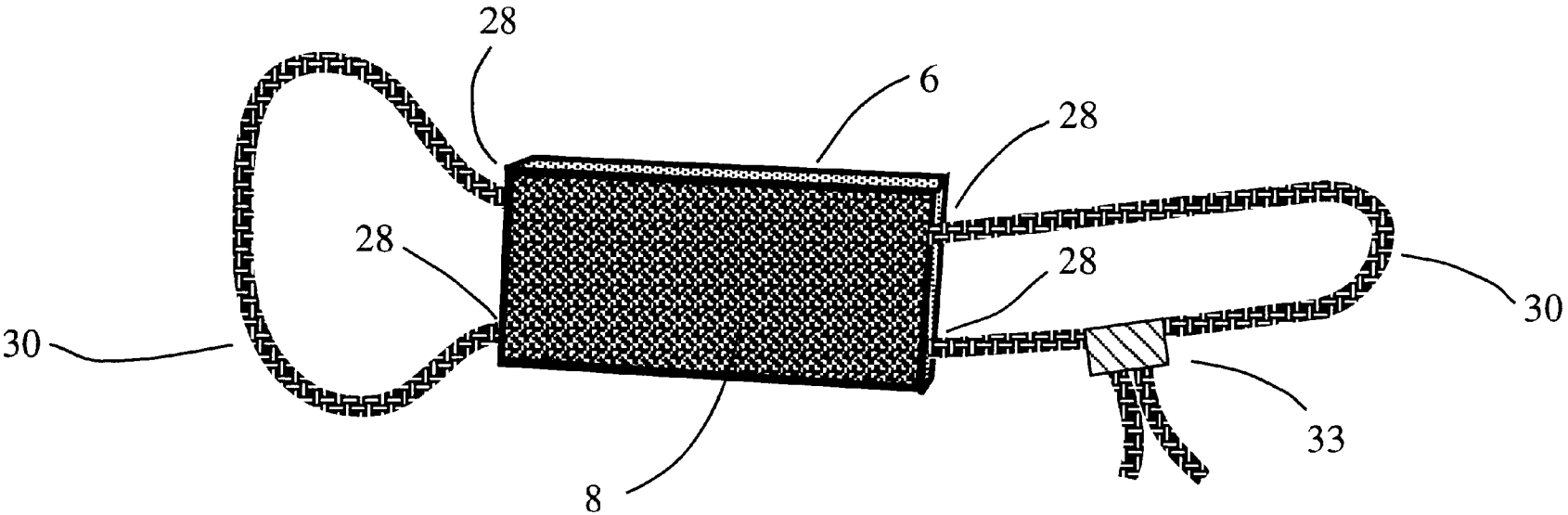
FIG. 10 shows a mounting device for a microphone or another transducer. An elastic cord passes through a pad which is faced with one part of a two part fastening system. The elastic cord is looped for attachment to separate parts of a musical instrument.

FIG. 10 shows the construction of a mounting device to aid the attachment of a microphone or another transducer, on to a musical instrument or other mechanical apparatus. The mounting device consists of a mounting pad 6 of rigid or semi-rigid material, such as wood or plastic, that embodies openings 28 to receive loops of elastic cord 30. The mounting pad 6 can be faced with the loop material 8 of a two part fastening system. An optional adjustment apparatus 33 may be attached to one of the elastic cord loops 30 for the purpose of shortening or lengthening the elastic cord loop 30 as required by specific applications.

Figure 11:
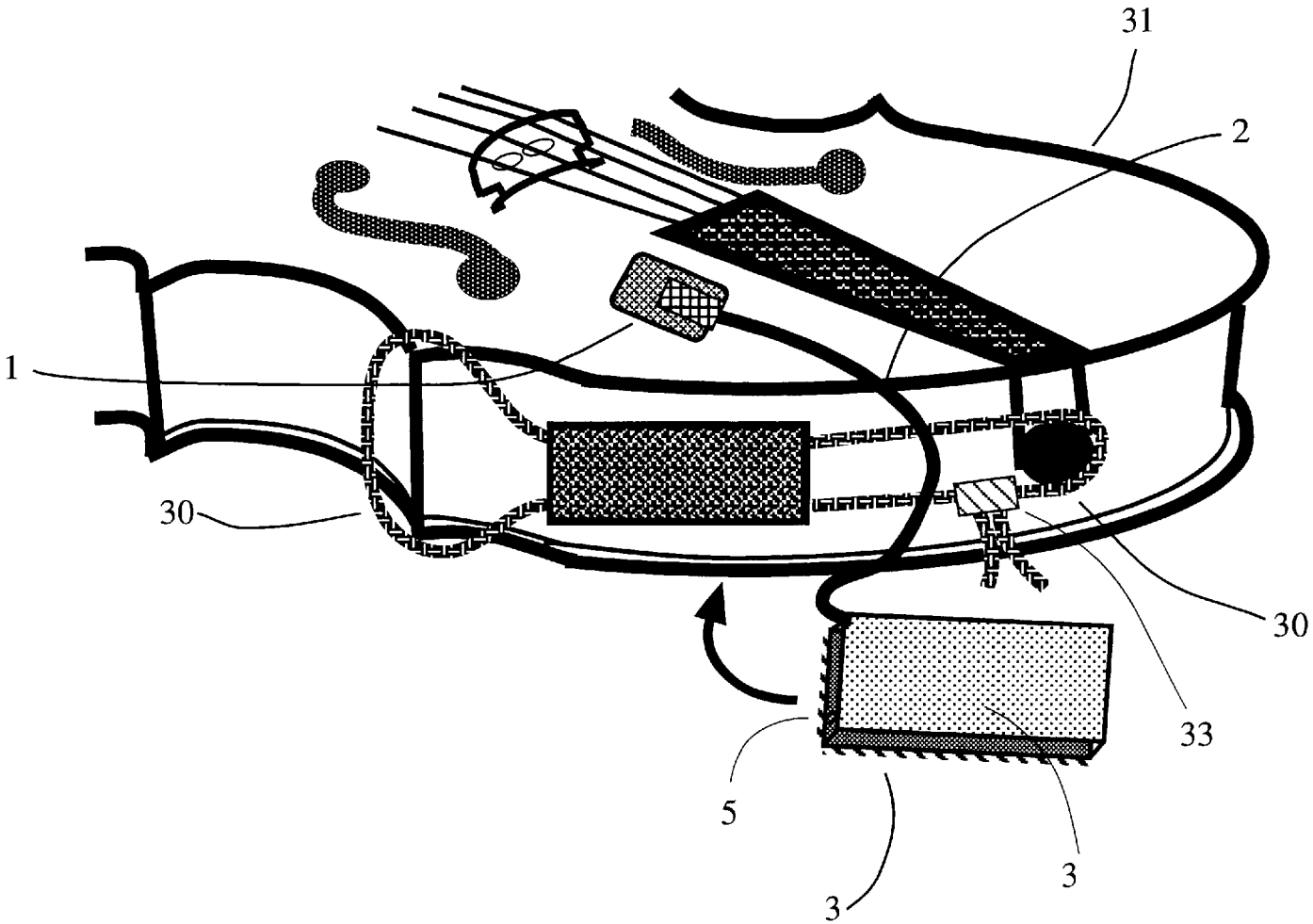
FIG. 11 shows the application of the mounting device of FIG. 10 to attach a microphone assembly on a violin.

FIG. 11 shows an application of the mounting device of FIG. 10 where a microphone assembly is attached to the mounting device for the purpose of recording the acoustical energy of a violin 31, or similar musical instrument. The mounting pad 6 can be attached to a violin 31 by fitting the elastic loops 30 around separate components of the violin 31. The service housing 3 of the microphone assembly is faced with the hook material 8 of a two part fastening system for attachment to the mounting pad 6 so that the gooseneck 2 and microphone element 1 may be properly positioned to record the acoustic energy of the violin 31.

Figure 12:
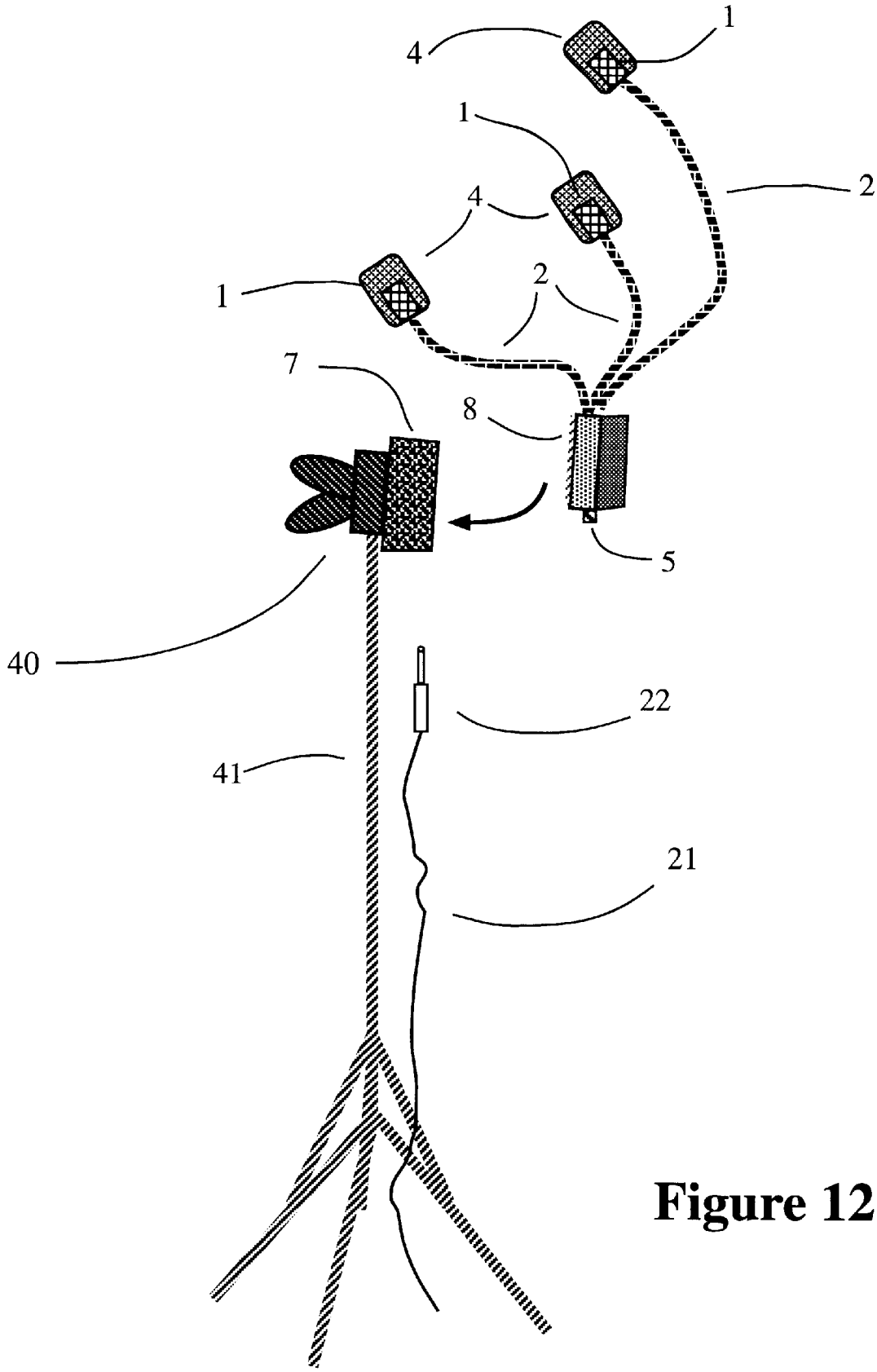
FIG. 12 shows a mounting pad faced with one part of a two part fastening system that is attached to a clip having opposing jaws. The clip permits attachment of the mounting pad to a free standing fixture.

FIG. 12 shows another mounting device for the microphone of FIGS. 1 & 2 where a mounting pad 6 faced with loop material 7 is attached to a clip 40 or similar clamping device having two opposing jaws. The clip 40 is shown attached to a self supporting fixture 41 and may receive the service housing 3 which is faced with the hook material 8. The three microphone elements 1 and goosenecks 2 may thereby be positioned in a variety of locations for the purpose of recording acoustical sound energy from a musical source. An audio connector 22 is shown attached to a cable 21 which can be received by the output connector 5 and permit the microphone elements 1 to communicate with other electronic apparatus.

Figure 13:
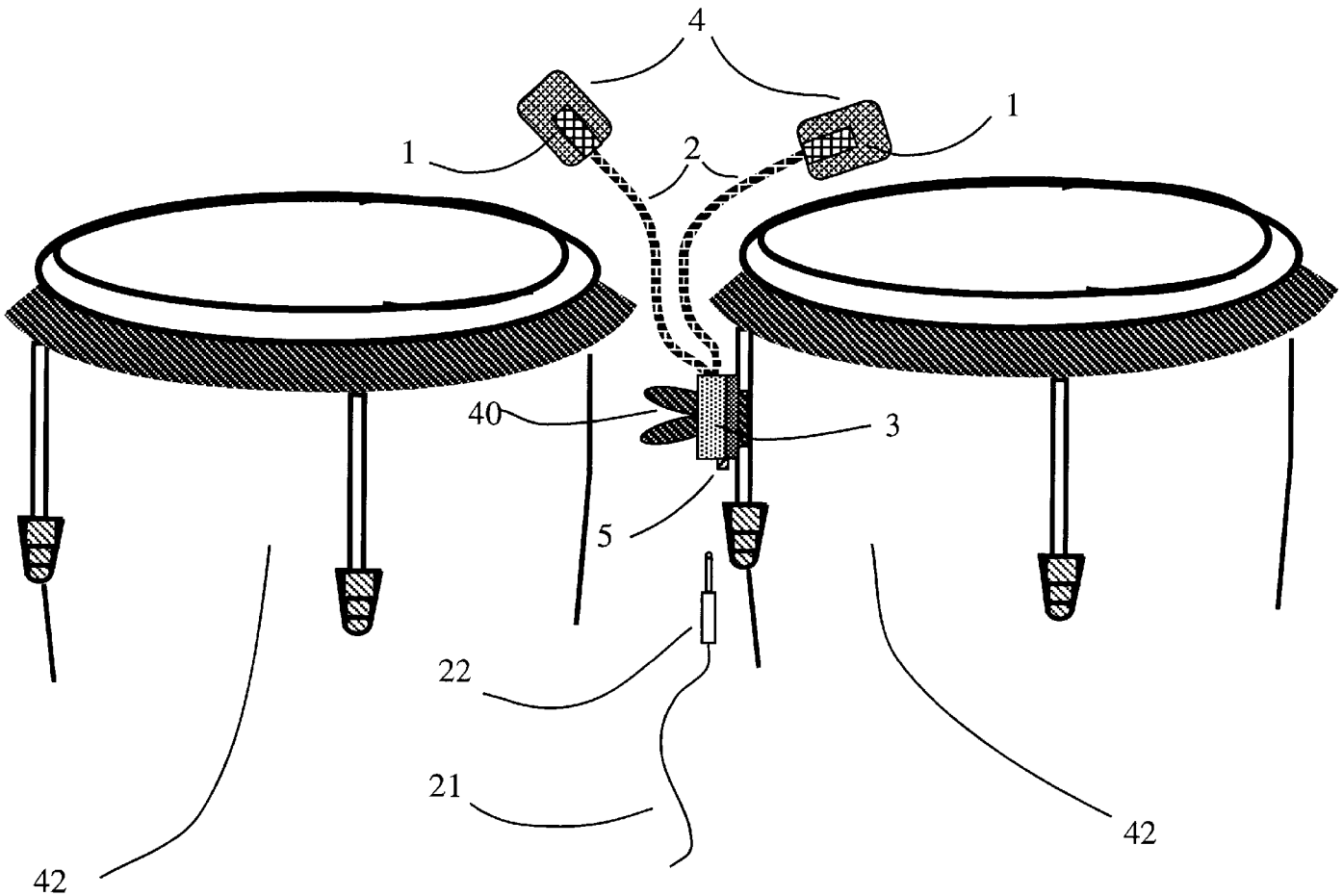
FIG. 13 shows a mounting pad with attached clip employed to attach a microphone assembly to a drum.

FIG. 13 shows a microphone assembly having two gooseneck sub-assemblies with the mounting designs of FIG. 12 to record drums 42.

FIGS. 14 through 17 show the construction of a gooseneck to support a microphone element or other transducer, and the method by which the microphone element is attached to the gooseneck.

Figure 14:
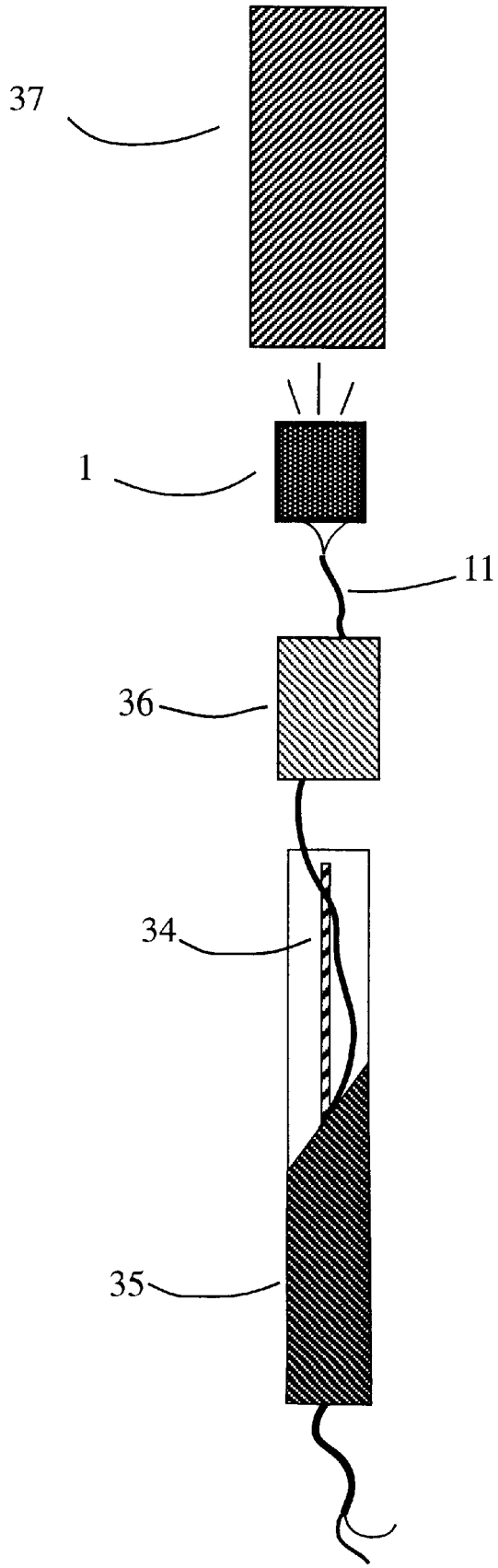
FIG. 14 shows an exploded view of the components of a microphone gooseneck assembly.

FIG. 14 shows an exploded view of the components used to construct the gooseneck. Rigidity is provided by a flexible rod 34 alongside of a flexible multiple conductor output cable 11 which conducts electronic signals from the microphone element 1 to other electronic apparatus. A section of flexible tubing 35 covers both the flexible rod 34 and the flexible output cable 11. The flexible tubing 35 must be sized to have an inside diameter slightly larger than the flexible rod 34 and the output cable 11 so that all three components will move and later remain stable as if they are a single unit. It is possible to use two or more layers of flexible tubing 35 of the same or different materials. It is also possible to use two or more flexible rods 34 for the purpose of providing greater support to the microphone element 1.

A microphone element 1 which is enclosed in it's own rigid housing is covered by a flexible tubular sheath 37 or multiple sheathes, composed of cloth fabric, thin rubber tubing, thin soft plastic tubing, or similar materials. This flexible tubular sheath will also cover the flexible output cable 11 in the immediate vicinity of the microphone element 1. Some microphone elements may not include their own rigid housing, and a separate rigid tubular housing may be required to cover the microphone element underneath the flexible tubular sheath 37.

Figure 15:
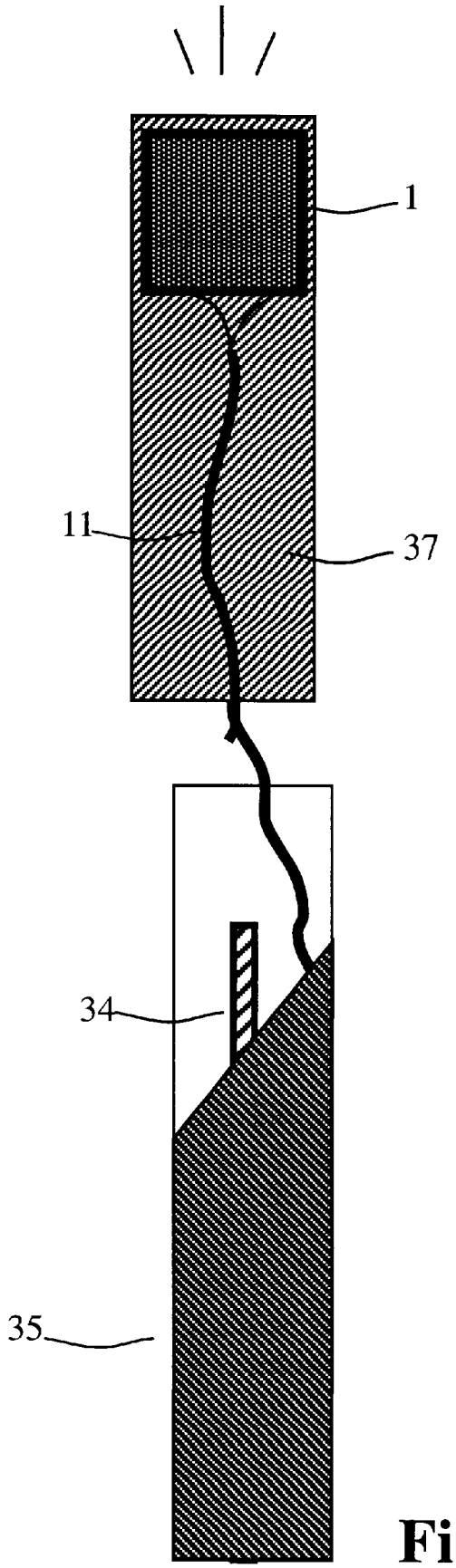
FIG. 15 show the components of FIG. 14 arranged into two separate sub-assemblies.

FIG. 15 shows the components of FIG. 14 arranged into two separate sub-assemblies. The first sub-assembly is composed of the microphone element 1 and flexible output cable 11 covered by the flexible sheath 37. The second sub-assembly is composed of the flexible rod 34 and flexible output cable 11 covered by the flexible tubing 35. The flexible sheath 37 covering the microphone may be later be permanently bonded to the tubing 35 of the gooseneck using adhesives, heat reduction, and/or natural friction of the materials. The complete gooseneck assembly will be sufficiently flexible to provide a wide range of placements for the microphone element 1, but there will be sufficient rigidity from flexible rod 34, to maintain the microphone element 1 in the desired location during usage. Any ambient mechanical energy which might travel up the flexible rod 34, or other components will be absorbed by the flexible sheath 37 and flexible output cable 11 to protect the microphone element 1 from distortion.

Figure 16:
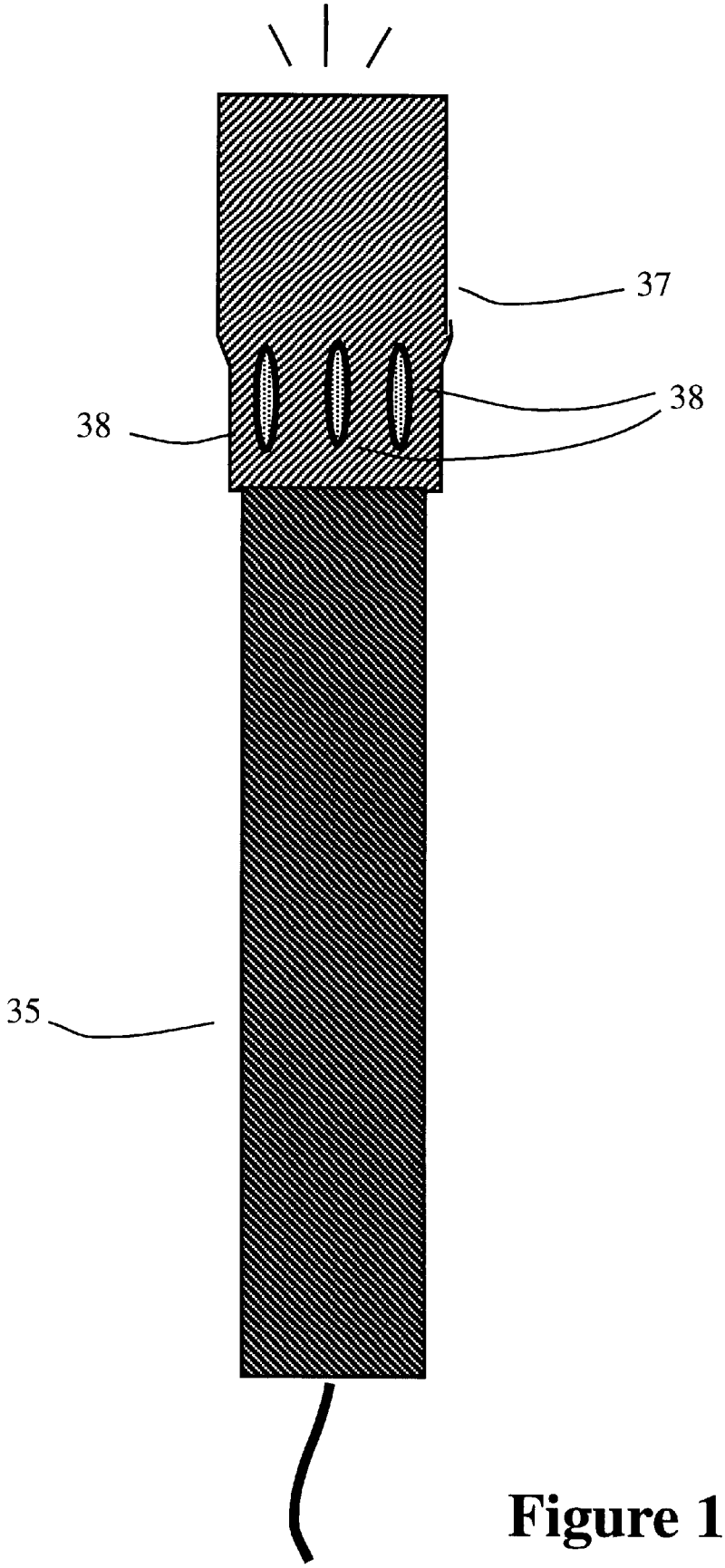
FIG. 16 shows the two sub-assemblies of FIG. 15 arranged as a single entity. Also shown are optional ports for exhausting of the microphone element.

FIG. 16 shows the completed gooseneck assembly with the flexible sheath 37 bonded to the flexible tubing 35 and the output cable 11 extending beyond the flexible tubing 35 so that the microphone element 1 may communicate beyond the gooseneck assembly. Optional exhaust ports 38 are shown located in the flexible sheath 37 to permit venting of the microphone element 1.

Figure 17:
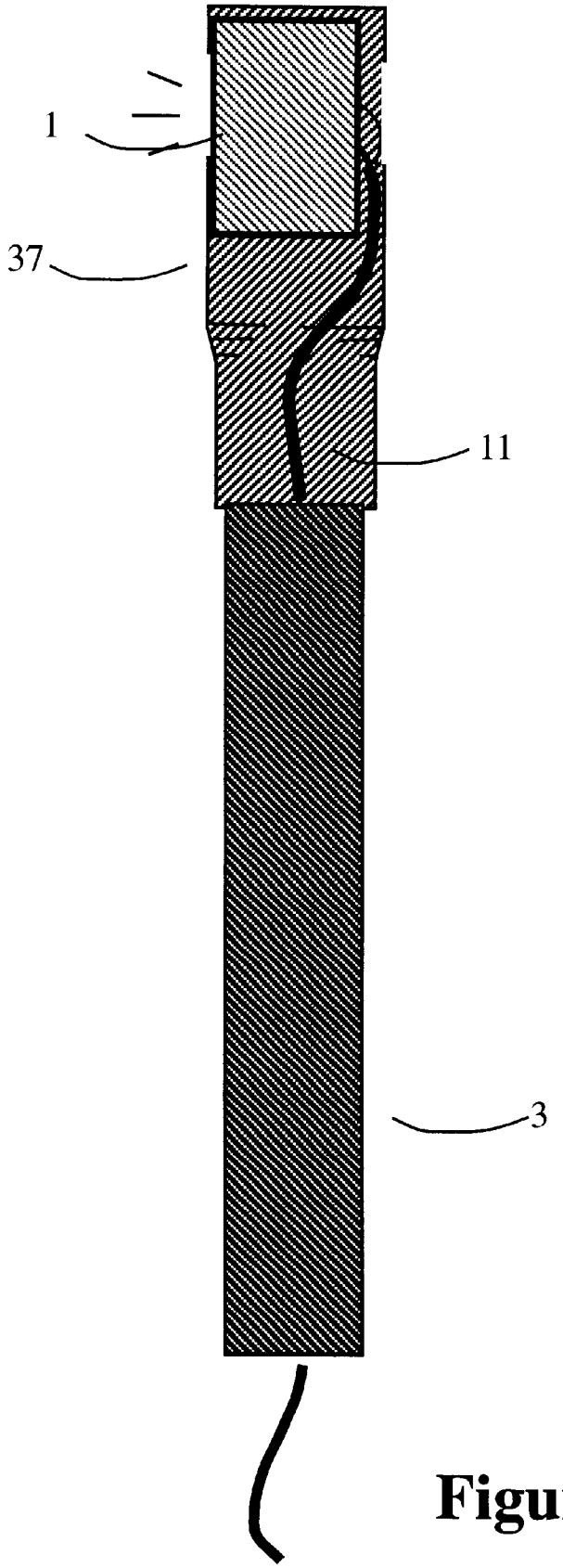
FIG. 17 shows a variation of FIG. 16 where the microphone element may receive acoustical energy at a 90 degree angle relative to the gooseneck.

FIG. 17 shows a variation of FIG. 16, where holes are cut into the side of the flexible sheath 37, and the microphone element 1 will communicate at a 90 degree angle to the gooseneck 3.

Figure 18:
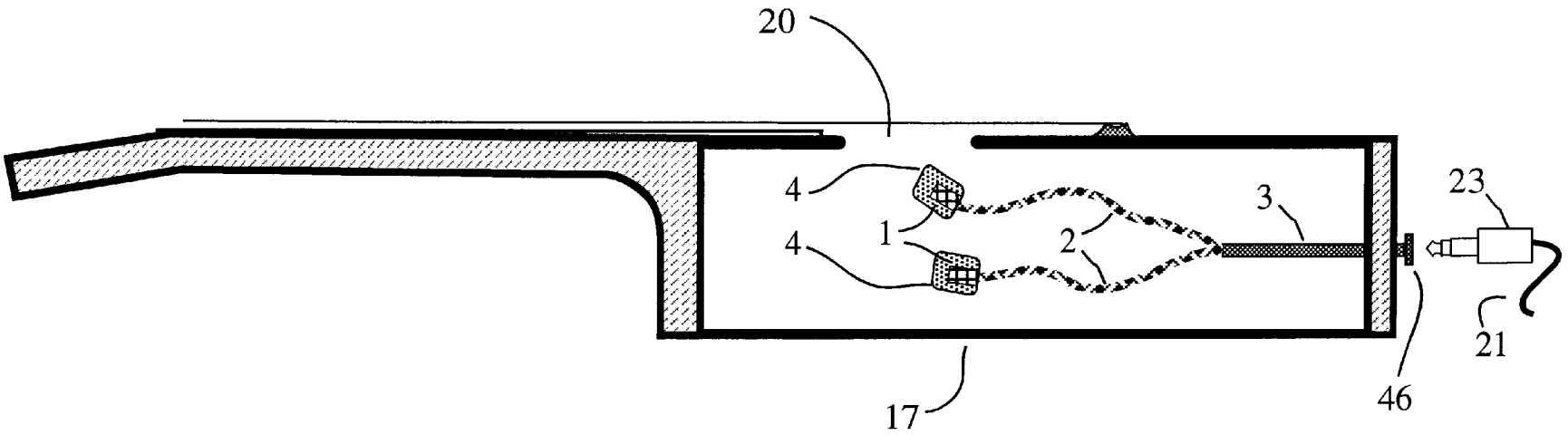
FIG. 18 shows a variation of the microphone of FIG. 1 connected directly to an output connector. The output connector may pass through the wall of a musical instrument, and is shaped to receive a strap to assist a player in holding the instrument.

FIG. 18 shows a variation of the microphone assembly of FIG. 1 which is mounted inside a guitar 17. The designs of FIG. 18 are based on a previous patent by the author of the present invention (U.S. Pat. No. 5,010,803). The goosenecks 2 emerge in a parallel direction from a service housing 3 which is attached directly to an output audio connector 46 that simultaneously functions as "end pin" or "strap button" for the guitar 17.

Figure 19:
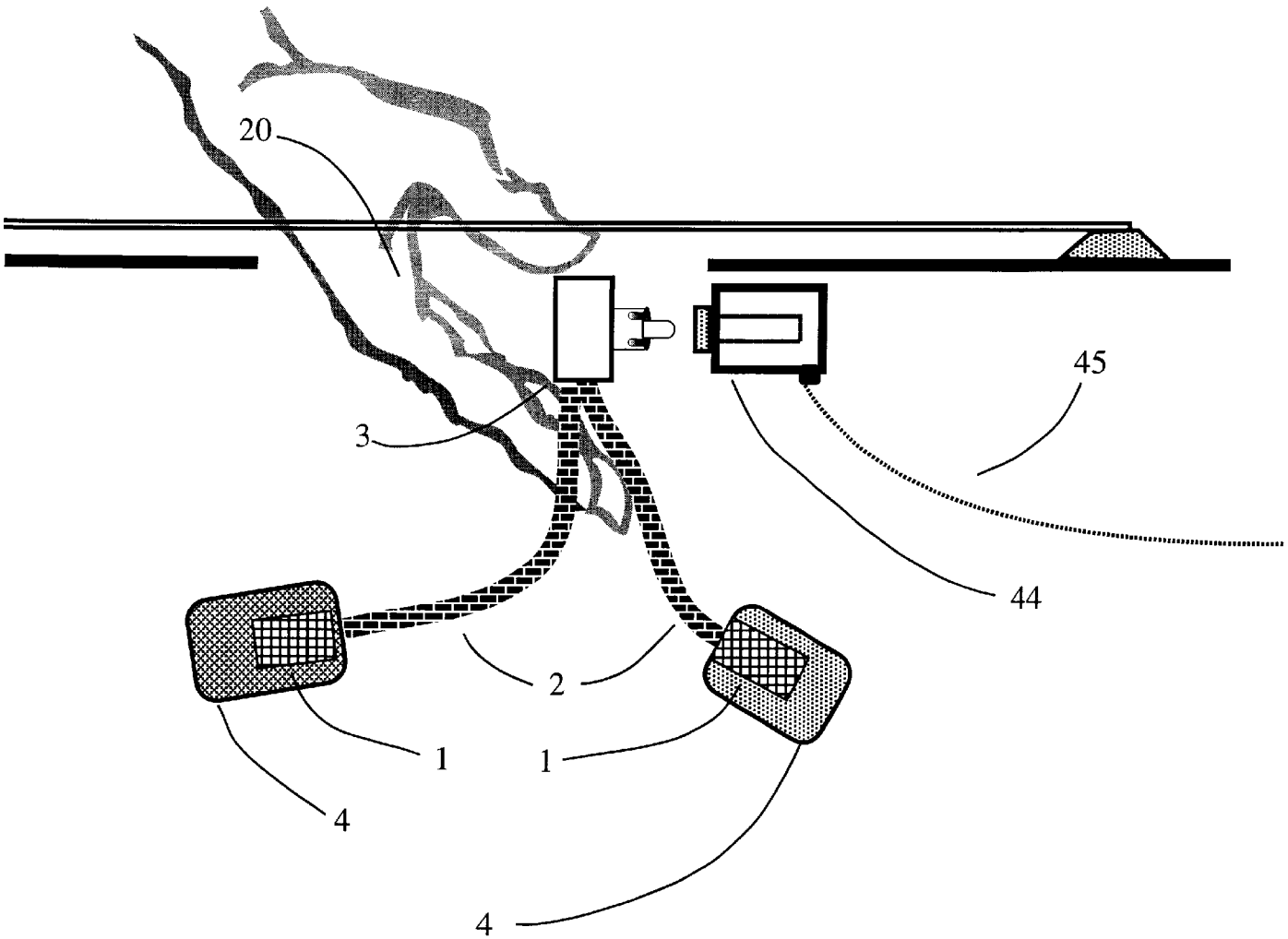
FIG. 19 shows a variation of the microphone of FIG. 1 where the service housing embodies output connectors. These output connectors may mate with other connectors embodied by a separate fixture attached to a musical instrument.

FIG. 19 shows a variation of the microphone assembly of FIG. 1 which is based on the designs a previous patent (U.S. Pat. No. 5,614,688) by the author of the present invention. The two goosenecks 2 emerge in a parallel direction from a single service housing 3. Mounted onto the service housing 3 is an RCA plug 43, or similar component of a two part audio connector system. The RCA jack 44, or similar connector component is permanently mounted near the soundhole 20 of a guitar or similar musical instrument, and may communicate with other electronic equipment inside or outside the musical instrument via an output cable 45. When the two parts of the audio connector system 43 & 44 are joined, the microphone elements will be physically mounted inside or outside the musical instrument, and be simultaneously electronically connected to any equipment communicating with the audio connector 44.

What is claimed is:

1. A transducer assembly comprising:

(a) a gooseneck sub-assembly further comprising a transducer element attached to a flexible mounting arm, (b) a service module comprising a housing which encloses electronic component means to service said transducer (c) a flexible multiple conductor cable means to electronically communicate between said transducer and said service module, (d) an elastic cord connected on its separate ends to said gooseneck sub-assembly and said service module, (e) and mounting appendages attached to said gooseneck sub-assembly and said service module such that when said mounting appendages are affixed to separate components of a musical instrument, the tension of said elastic cord will serve to securely mount said microphone assembly onto said musical instrument.

2. A microphone assembly as described in claim 1 wherein multiple gooseneck sub-assemblies are attached to said mounting appendage at an end of the elastic cord opposite said service module.

3. A microphone assembly as described in claim 1 wherein said mounting appendages comprise a rigid mechanism in the form of a hook covered with a non-abrasive protective material.

4. A microphone assembly as described in claim 1 wherein said mounting appendages for said service module comprise (a) one part of a two part "hook and loop" fastening system is affixed to a flat surface of said service module, (b) and a second part of the fastening system is affixed to a flat surface of a separate mounting pad which comprises loops of elastic cord that may be stretched and attached to various components of a musical instrument such that said service module may by mounted onto said musical instrument by mating said two parts of said two part fastening system.

5. A transducer assembly as described in claim 1 wherein a cover for a transducer element comprises:

(a) a block of foamlike material which embodies an opening to receive and enclose said transducer element, (b) partitions embedded within said block of foam in patterns to encircle said transducer element (c) and said partitions are composed of webinglike materials having less porosity than said block of foamlike material in order to filter acoustical energy before such energy is received by said transducer element.

6. A microphone assembly as described in claim 5 where in said webinglike material is screening.

7. A microphone assembly as described in claim 5 where in said webinglike material is sheeting.

* * * * *